US009885327B2

(12) United States Patent
Morgillo et al.

(10) Patent No.: US 9,885,327 B2
(45) Date of Patent: Feb. 6, 2018

(54) INTAKE MODULE COMBINATION

(71) Applicant: Mahle International GmbH, Stuttgart (DE)

(72) Inventors: Ivano Morgillo, Neuhuetten (DE); Winfried Brand, Stuttgart (DE)

(73) Assignee: Mahle International GmbH (DE)

( * ) Notice: Subject to any disclaimer, the term of this patent is extended or adjusted under 35 U.S.C. 154(b) by 56 days.

(21) Appl. No.: 14/770,414

(22) PCT Filed: Feb. 19, 2014

(86) PCT No.: PCT/EP2014/053192

§ 371 (c)(1),
(2) Date: Aug. 25, 2015

(87) PCT Pub. No.: WO2014/131663

PCT Pub. Date: Sep. 4, 2014

(65) Prior Publication Data

US 2015/0377195 A1 Dec. 31, 2015

(30) Foreign Application Priority Data

Feb. 26, 2013 (DE) ..... 10 2013 203 096

(51) Int. Cl.
*F02M 35/024* (2006.01)
*F02M 35/16* (2006.01)
(Continued)

(52) U.S. Cl.
CPC ..... *F02M 35/161* (2013.01); *F02M 35/104* (2013.01); *F02M 35/10072* (2013.01); *F02M 35/10078* (2013.01); *F02M 35/10085* (2013.01)

(58) Field of Classification Search
CPC ..... F02M 35/161; F02M 35/104; F02M 35/10072; F02M 35/10078; F02M 35/10085
(Continued)

(56) References Cited

U.S. PATENT DOCUMENTS 4,069,796 A * 1/1978 Balsley ..... F02F 7/006 123/184.41
4,425,881 A * 1/1984 Lyndhurst ..... F02B 29/0475 123/184.34
(Continued)

FOREIGN PATENT DOCUMENTS

DE 4332559 A1 3/1995
DE 19528047 A1 2/1997
(Continued)

OTHER PUBLICATIONS

English abstract for DE-19943928.
English abstract for DE-102011111124.
English abstract for DE-4332559.

*Primary Examiner* — Marguerite McMahon
(74) *Attorney, Agent, or Firm* — Fishman Stewart PLLC

(57) ABSTRACT

An assembly for an internal combustion engine may include an intake module of a fresh air system for supplying fresh air to at least one combustion chamber of the internal combustion engine and an attachment part attached to the intake module in a joining direction. The intake module may include at least one retaining surface facing away from the attachment part. The attachment part may include at least one counter retaining surface facing away from the intake module. At least one reinforcing element may be disposed between the intake module and the attachment part and may interact with the at least one retaining surface and the at least one counter retaining surface. The at least one retaining element may be moveable in a movement direction extend-
(Continued)

ing transverse to the joining direction between a releasing position and a securing position.

17 Claims, 7 Drawing Sheets

(51) Int. Cl.
*F02M 35/10* (2006.01)
*F02M 35/104* (2006.01)

(58) Field of Classification Search
USPC ..... 123/184.21–184.61, 542
See application file for complete search history.

(56) References Cited

U.S. PATENT DOCUMENTS

| | | | | |
|---|---|---|---|---|
| 5,653,200 | A | 8/1997 | Hafner et al. | |
| 6,067,953 | A * | 5/2000 | Bloomer | F02M 35/10039 123/184.21 |
| 6,174,343 | B1 | 1/2001 | Bloomer | |
| 6,755,169 | B2 | 6/2004 | Storz | |
| 7,055,499 | B1 * | 6/2006 | Kuwano | F02B 27/02 123/184.61 |
| 2003/0121242 | A1 | 7/2003 | Rieger et al. | |
| 2012/0298063 | A1 * | 11/2012 | Schieszl | F16L 37/113 123/184.21 |
| 2013/0276763 | A1 * | 10/2013 | Eilemann | F02B 29/0412 123/542 |

FOREIGN PATENT DOCUMENTS

| | | | |
|---|---|---|---|
| DE | 19943928 | C1 | 12/2000 |
| DE | 10026437 | A1 | 12/2001 |
| DE | 102011111124 | A1 | 2/2013 |
| EP | 1156205 | A2 | 11/2001 |
| EP | 1283351 | A2 | 2/2003 |
| WO | WO 2014/016253 | A1 * | 7/2013 |

* cited by examiner

INTAKE MODULE COMBINATION

CROSS-REFERENCE TO RELATED APPLICATIONS

This application claims priority to German Patent Application No. 10 2013 203 096.7, filed Feb. 26, 2013, and International Patent Application No. PCT/EP2014/053192, filed Feb. 19, 2014, both of which are hereby incorporated by reference in their entirety.

TECHNICAL FIELD

The present invention relates to a combination of an intake module of a fresh air system for feeding fresh air to combustion chambers of an internal combustion engine, in particular of a motor vehicle, having an attachment part, to which the intake module is attached.

BACKGROUND

DE 195 28 047 A1 discloses such a combination, in which the attachment part is formed by a cylinder head, in which the combustion chambers of the internal combustion engine are formed. The intake module has a plurality of retaining surfaces, while the attachment part has a plurality of counter retaining surfaces. Furthermore, at least one retaining element is provided, which is arranged such that it can be displaced in a movement direction, which extends transversely to a joining direction, in which the intake module is joined to the attachment part, between a releasing position and a securing position. In the releasing position, the intake module can be joined to or removed from the attachment part. In the securing position, the retaining element interacts with the retaining surfaces and with the counter retaining surfaces to secure the intake module on the attachment part. This produces a fastening for the intake module to the attachment part that is particularly easy to use, as a result of which the combination of intake module and attachment part can be assembled particularly simply and can be produced inexpensively.

In the known combination, the retaining surfaces and the counter retaining surfaces face away from each other, whereas the respective retaining element is configured as a clamp of C-shaped profile, so that the respective retaining element can fit over the retaining surfaces and the counter retaining surfaces from outside and prestress them against each other. A disadvantage of the known combination is that comparatively large forces must be applied with the respective retaining element to be able to hold the intake module in position on the respective attachment part with sufficient firmness. To this end, the respective retaining element must be correspondingly large and complex.

SUMMARY

The present invention is concerned with the problem of specifying an improved or at least another embodiment for such a combination of an intake module having an attachment part, which has a compact design and/or can be produced inexpensively.

This problem is solved according to the invention by the subject matter of the independent claim. Advantageous embodiments form the subject matter of the dependent claims.

The invention is based on the general concept of configuring the connection between the intake module and the attachment module by means of the respective retaining surface and the respective counter retaining surface in such a manner that the respective retaining element is no longer loaded in a tensile manner, but in a compressive manner. Furthermore, the respective retaining surface and the respective counter retaining surface are arranged in such a manner that they face each other and that the respective retaining element can be arranged therebetween in the joining direction. The fastening between the intake module and the attachment part can be made comparatively compact in this manner. At the same time, the respective retaining element can thereby also be small and compact in the joining direction and can meet the compressive forces that occur with sufficient strength and stability. The proposed structure thus allows the respective retaining element to be comparatively small, while being able to absorb relatively high compressive forces. To this end, the respective retaining element is supported both on the respective retaining surface and on the respective counter retaining surface in the joining direction when in the securing position.

According to an advantageous embodiment, the respective counter retaining surface can be formed on a counter retainer of the attachment part, which is guided parallel to the joining direction through a retainer gap, which is formed between retainers of the intake module that are adjacent in the movement direction, the respective retainer each having one of the retaining surfaces. Alternatively, it can be provided for the respective retaining surface to be formed on a retainer of the intake module, which is guided parallel to the joining direction through a counter retainer gap, which is formed between counter retainers of the attachment part that are adjacent in the movement direction, each counter retainer having one of the counter retaining surfaces. These two alternative embodiments can also be realised cumulatively. The retainers and the counter retainers can particularly simply be dimensioned such that they can absorb comparatively large tensile forces, so the intended compact design is also supported thereby. The guiding of the respective retainer through a counter retainer gap means that the retaining surfaces and the counter retaining surfaces can particularly simply be arranged such that they face each other and can hold the respective retaining element between them.

According to another advantageous embodiment, the respective retaining element can be guided in the movement direction on the respective retaining surface and/or on the respective counter retaining surface and can be moved relative to the intake module and relative the attachment part. In this manner, an additional functionality can be integrated into the respective retaining surface or into the respective counter retaining surface, namely a guiding function, in particular a longitudinal guide for the respective retaining element in the movement direction. In this manner, the production of the fixed connection between the intake module and the attachment part is simplified, which makes assembly correspondingly easier.

In another advantageous embodiment, a tongue and groove guide, which is oriented in the movement direction, can be formed between the respective retaining element and the respective retaining surface and/or the respective counter retaining surface. Such a tongue and groove guide can be used to realise a longitudinal guide of the retaining element in the movement direction particularly simple and reliably. At the same time, a fixing or positioning of the retaining element transversely to its movement direction and transversely to the joining direction can be realised.

In another advantageous embodiment, the respective retaining element can be configured as a profiled rod, which has a constant cross-sectional profile in its longitudinal direction, which runs parallel to the movement direction. The respective retaining element can thereby be produced particularly simply, for example an extruded body or extrusion press body.

In another advantageous embodiment, the respective retaining surface can be formed on a retainer of the intake module, while the respective counter retaining surface is formed on a counter retainer of the attachment part. Furthermore, the respective retaining element can then have a receiving pocket for the respective retainer or for the respective counter retainer, which pocket is open in the movement direction to an insertion gap, which is open parallel to the joining direction. This design of the respective retaining element allows the securing function and the guiding function to be separated from each other, as a result of which for example the guide can be simplified.

A development is then particularly expedient, in which the respective retainer or the respective counter retainer can be inserted into the respective insertion gap in the joining direction when the respective retaining element is in the releasing position. In other words, when the respective retaining element is in the releasing position, the intake module can be joined to the attachment part in the joining direction, the respective retainer or the respective counter retainer then automatically passing into the associated insertion gap. The respective retainer or the respective counter retainer is inserted into the insertion gap in the insertion direction until it is arranged flush with the respective receiving pocket in the movement direction. Displacement of the retaining element into the securing position thereof then causes the respective retainer or the respective counter holder to pass into the associated receiving pocket, so that when it reaches the securing position it is delimited by the retaining element on both sides parallel to the joining direction in the respective receiving pocket. The respective retaining element thereby can be used in a particularly simple and reliable manner.

According to another embodiment, the respective retaining element can be supported in each case on an adjacent retaining surface on both sides of the respective counter retaining surface in the movement direction, as a result of which a stable, broad support and force transmission is achieved. An inverted design can also be realised alternatively or additionally, in which the respective retaining element is supported in each case on an adjacent counter retaining surface on both sides of the respective retaining surface in the movement direction.

According to another embodiment, at least one guide pin can be arranged on the intake module, which guide pin is oriented parallel to the joining direction and passes into a guide opening formed in the attachment part when the intake module is joined to the attachment part, in order to position the intake module in a predefined relative position to the attachment part. In this case too, an inverted design is additionally or alternatively conceivable, in which at least one guide pin is arranged on the attachment part, which guide pin is oriented parallel to the joining direction and passes into a guide opening formed in the intake module when the intake module is joined to the attachment part, in order to position the intake module in a predefined relative position to the attachment part. Such a guide pin, which interacts with a complementary guide opening when the intake module is joined, can be used to realise the desired positioning of the intake module on the attachment part particularly simply and reliably, which makes assembly much simpler. In particular, the predefined relative position between intake module and attachment part can be selected such that the retaining element can then be moved from its releasing position into its securing position particularly easily. An embodiment is particularly expedient in which the respective guide pin can be used to prestress the intake module against the attachment part in order to simplify the movement of the retaining element. For example, the respective guide pine can be screwed into the intake module with a first threaded section and project through the respective guide opening with a second threaded section and can be tightened against the attachment part by means of a nut on a side facing away from the intake module. The nut can be provided either just for the assembly process or else can be provided permanently for prestressed fixing of the intake module to the attachment part.

In another advantageous embodiment, at least one end stop can be provided, which defines the securing position of the respective retaining element. Such an end stop can be formed on the intake module and/or on the attachment part and interact with an end face of the retaining element. It is thereby haptically perceptible in a particularly simple manner for the respective fitter when the securing position is reached.

Additionally or alternatively, at least one latching device can be provided, which latches when the securing position is reached and fixes the respective retaining element in the securing position. The latching means that the retaining element is secured against undesirable displacement into the releasing position. Such latching can in particular be combined with a stop of the above-described type, so latching takes place when the stop is reached. The latching can in particular be indicated by an audible latching signal, that is, in particular by a typical latching noise. These measures also simplify assembly.

According to another advantageous embodiment, the at least one retaining element can have at least one convex prestressing contour, which is opposite the respective retaining surface or the respective counter retaining surface in the joining direction when in the securing position. Such a convex prestressing contour defines an outwardly projecting curve on an outer side of the retaining element facing the retaining surface or an outer side of the retaining element facing the respective counter retaining surface, which corresponds to a widening of the cross section of the retaining element. This design can be used to provide play in the joining direction between the retaining element and the respective retaining surface or the respective counter retaining surface, so that the retaining element can easily be displaced in the releasing position. When the retaining element is displaced into the securing position, this play is eliminated with the aid of the prestressing contour. Moreover, the prestressing contour can be dimensioned such that a desired prestress is also produced between intake module and attachment part when the retaining element is displaced into the securing position, which prestress is oriented in the joining direction. Furthermore, the retaining element can compensate production tolerances with the respective prestressing contour, which tolerances can lead for example to different distances measured in the joining direction between the respective retaining surface and the respective counter retaining surface.

According to another advantageous embodiment, a charge air cooler can be arranged in the intake module. This makes the combination presented here particularly suitable for use in a forced induction internal combustion engine.

Additionally or alternatively, the attachment part can be an engine block or a cylinder head of such an engine block. In this case, the intake module is thus mounted directly on the engine block. Alternatively, the attachment part can also be an intermediate flange, which for its part is provided for attachment to an engine block or to a cylinder head of such an engine block. Such an intermediate flange is generally used to accommodate flaps, in particular tumble flaps or turbulence flaps or swirl flaps.

In principle, this intermediate flange can also be fastened to the engine block or to the cylinder head in the above-described manner, this intermediate flange then replacing the intake module in the combination according to the invention.

Further important features and advantages of the invention can be found in the subclaims, the drawings and the associated description of the figures using the drawings.

It is self-evident that the above-mentioned features and those still to be explained below can be used not only in the combination given in each case but also in other combinations or alone without departing from the scope of the present invention.

Preferred exemplary embodiments of the invention are shown in the drawings and are explained in more detail in the description below, the same reference symbols referring to the same or similar or functionally equivalent components.

BRIEF DESCRIPTION OF THE DRAWINGS

In the figures.

DETAILED DESCRIPTION

Figure 1:
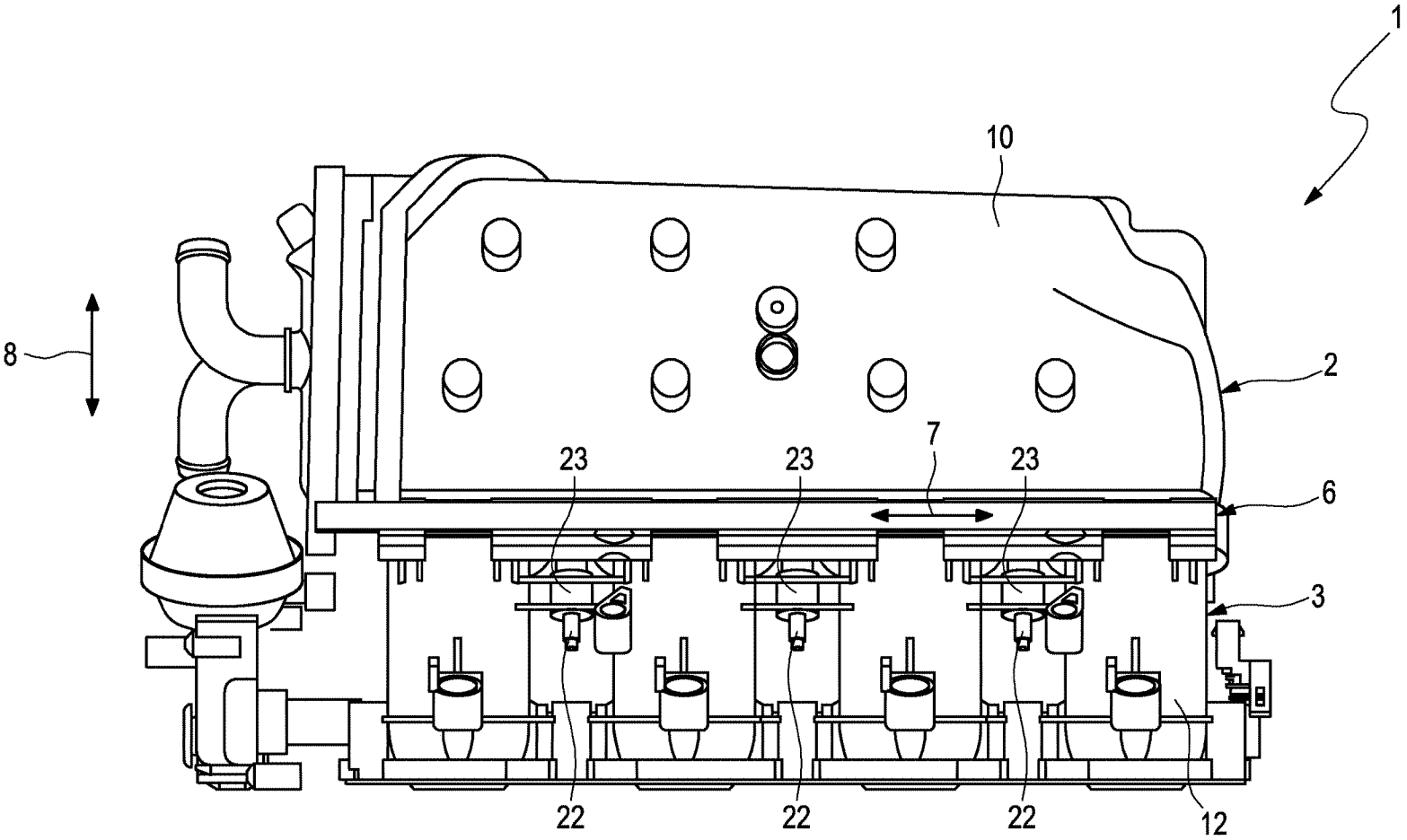
FIG. 1 schematically shows a side view of a combination in the assembled state, FIG. 2 schematically shows an isometric view of a detail of the combination with the intake module removed from an attachment part and with a retaining element in its releasing position, FIG. 3 schematically shows an isometric view as in FIG. 2, but with the intake module joined to the attachment part, FIG. 4 schematically shows an isometric view as in FIG. 3, but with the retaining element moved into a securing position, FIG. 5 schematically shows a slightly isometric cross section of the combination, FIG. 6 schematically shows an isometric view of the combination in the region of a connecting point between intake module and attachment part, with the retaining element moved into its releasing position, but in another embodiment, FIG. 7 schematically shows an isometric view as in FIG. 6, but with the retaining element moved into its securing position, FIGS. 8 to 10 each schematically show a highly simplified longitudinal section of the combination in the region of a retaining element in its securing position, in different embodiments.

According to FIGS. 1 to 10, a combination 1 comprises an intake module 2 and an attachment part 3. The intake module 2 is a part of a fresh air system for supplying fresh air to combustion chambers of an internal combustion engine (not shown here), which can in particular be arranged in a vehicle. In the embodiments shown here, the attachment part 3 is an intermediate flange, which for its part is provided for attachment to an engine block of the internal combustion engine, in particular to a cylinder head of the engine block. Such an intermediate flange can contain flaps (not shown here) to influence the fresh air stream to the individual combustion chambers. Alternatively thereto, in another embodiment, the intake module 2 can also be attached directly to the engine block or cylinder head, the engine block or cylinder head then representing the attachment part 3.

The intake module 2 has at least one retaining surface 4. A plurality of retaining surfaces 4 is provided in each of the embodiments shown here. In particular, a plurality of such retaining surfaces 4 is provided on each of two sides of the intake module 2, which face away from each other. The attachment part 3 has at least one counter retaining surface 5. The embodiments shown here each have a plurality of counter retaining surfaces 5. In this case too, a plurality of such counter retaining surfaces 5 is expediently provided on each of two sides of the attachment part 3, which face away from each other.

Figure 2:
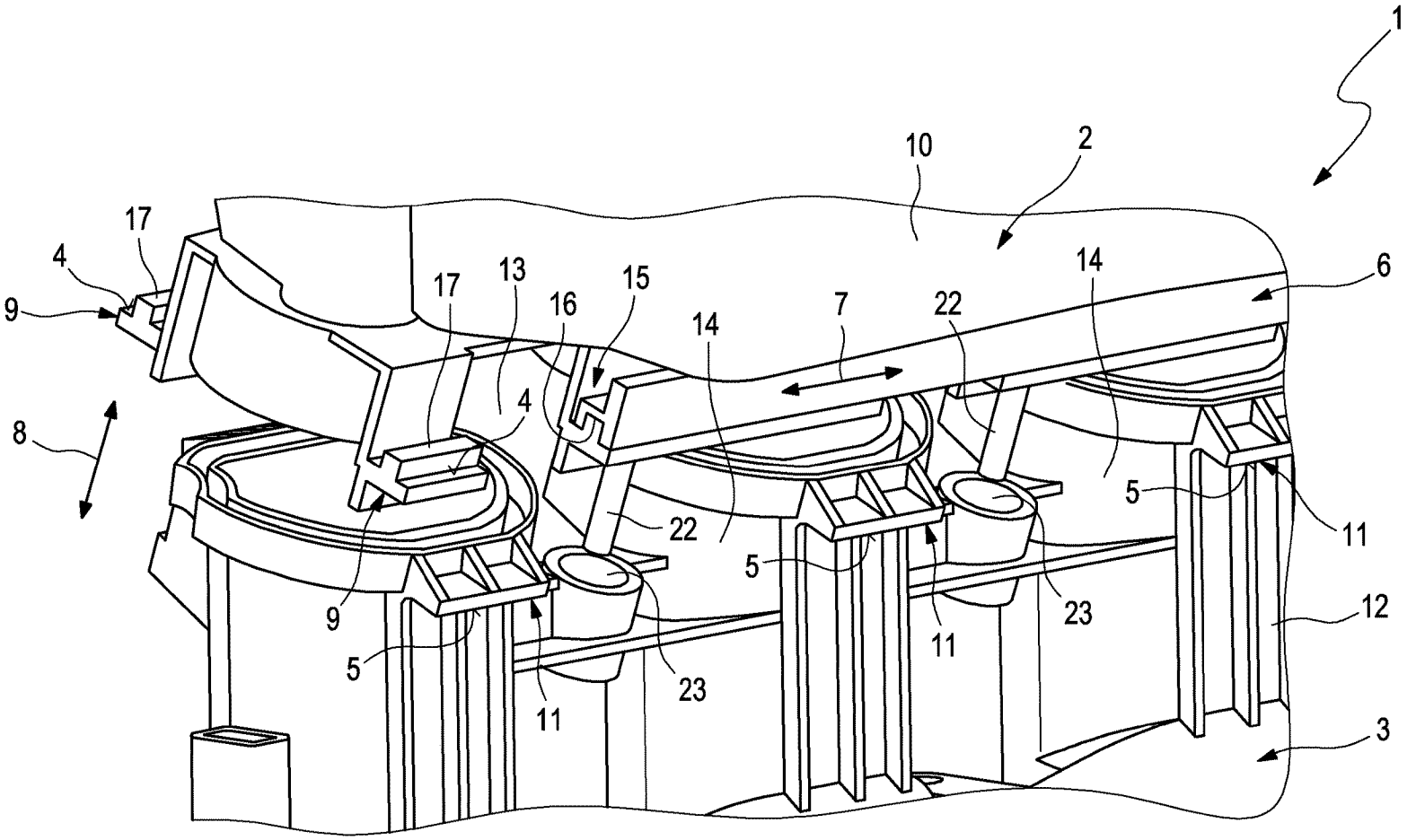
Figure 3:
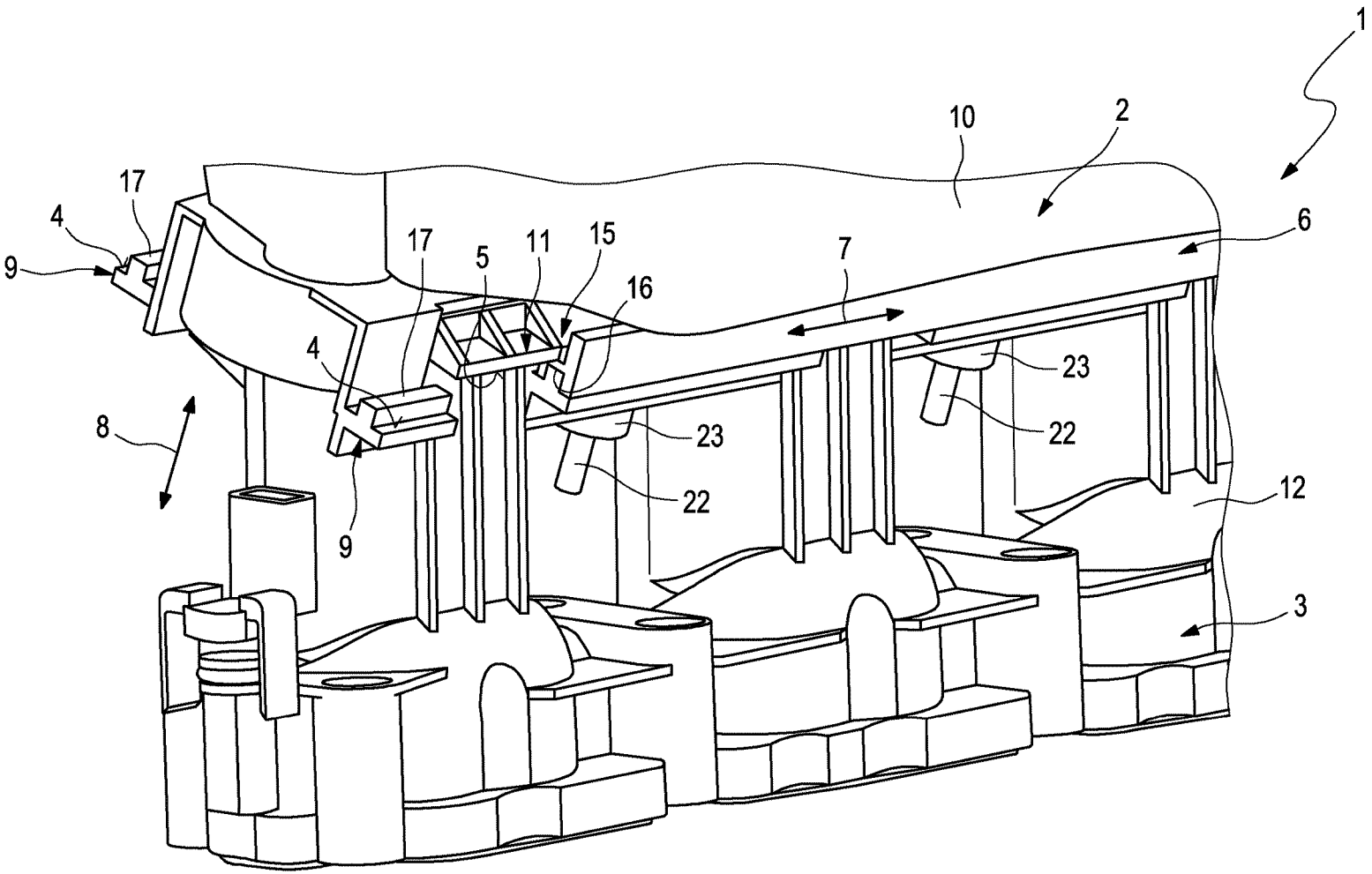
Figure 4:
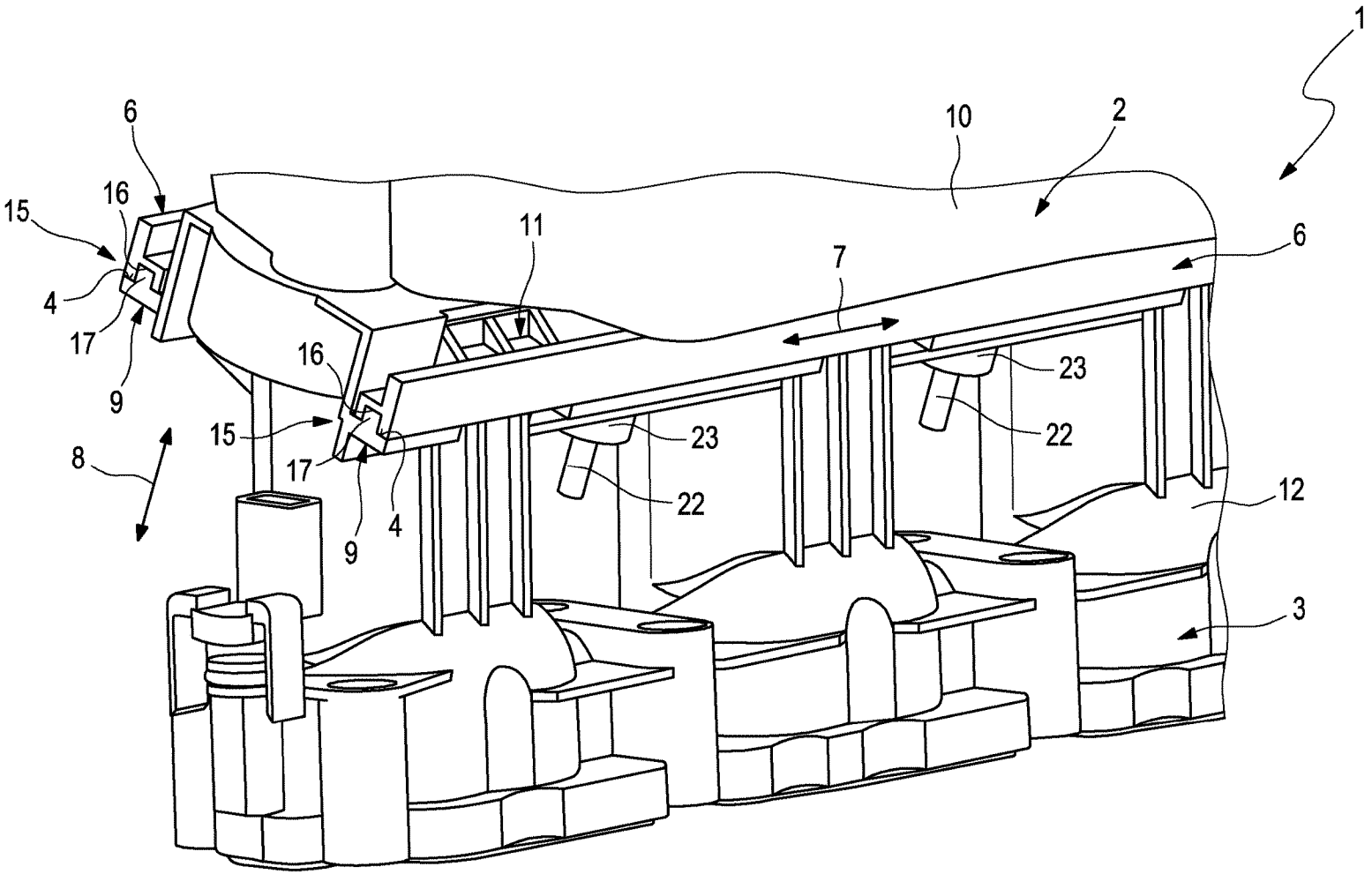

The combination 1 also comprises at least one retaining element 6, which interacts with the retaining surfaces 4 and with the counter retaining surfaces 5. In the embodiments shown here, such a retaining element 6 is arranged on each of the two sides of the intake module 2 and attachment part 3 that face away from each other, which retaining element interacts with the retaining surfaces 4 and counter retaining surfaces 5 associated with the respective side. The respective retaining element 6 can be displaced in a movement direction 7 between a releasing position, which is shown in FIGS. 2, 3 and 6, and a securing position, which is shown in FIGS. 1, 4, 5 and 7 to 10. The movement direction 7 extends transversely to a joining direction 8, in which the intake module 2 is joined to the attachment part 3. In the releasing position, the intake module 2 can be joined to or removed from the attachment part 3. In the securing position, however, the intake module 2 is fastened to the attachment part 3, to which end the respective retaining element 6 interacts with the retaining surfaces 4 and the counter retaining surfaces 5.

In the combination presented here, the retaining surfaces 4 and the counter retaining surfaces 5 face each other when the intake module 2 is joined to the attachment part 3. This arrangement can be seen in particular in FIGS. 3, 4, 6 and 7. In these figures, the respective retaining surface 4 is oriented upwards, that is, towards the intake module 2, while the respective counter retaining surface 5 is oriented downwards, that is, towards the attachment part 3. The retaining surfaces 4 and the counter retaining surfaces 5 are also arranged in such a manner that a space is formed in the joining direction 8 between the retaining surfaces 4 and the counter retaining surfaces 5 when in the joined state, into which space the retaining element 6 can be introduced, so that the retaining element 6 is arranged between the retaining surfaces 4 and the counter retaining surfaces 5 in the joining direction 8 when in its securing position. Furthermore, the retaining element 6 is supported on the retaining surfaces 4 and on the counter retaining surfaces 5 in the joining direction 8 when in its securing position.

The intake module 2 has a plurality of retainers 9, on each of which a retaining surface 4 is formed. The retainers 9 are preferably formed integrally on a housing 10 of the intake module 2. The housing 10 is expediently an injection-moulded part produced from plastic. The attachment part 3 has a plurality of counter retainers 11, on each of which a counter retaining surface 5 is formed. The counter retainers 11 are in this case formed integrally on a body 12 of the attachment part 3. The intermediate flange, which in this case represents the attachment part 3, expediently has a body 12 injection-moulded from plastic, as a result of which the integral design can be realised particularly easily.

The retainers 9 are arranged adjacently parallel to the movement direction 7 on the respective side of the intake module 2, a retainer gap 13 being formed in each case between adjacent retainers 9. The counter retainers 11 are also arranged adjacently parallel to the movement direction 7 on the respective side of the attachment part 3, a counter retainer gap 14 being present between each adjacent pair of retainers 11 in this case too. The retainers 9 are now dimensioned in a complementary manner to the counter retainer gaps 14 and the counter retainers 11 are dimensioned in a complementary manner to the retainer gaps 13. This makes it possible to join the intake module 2 to the attachment part 3 in the joining direction 8 in such a manner that, on the respective side of the combination 1, the retainers 9 are guided through the counter retainer gaps 14 while at the same time the counter retainers 11 are guided through the retainer gaps 13. In the joined state, the situation is then produced in which the retaining surfaces 4 and the counter retaining surfaces 5 are opposite each other in the joining direction 8.

In the embodiments shown here, the retaining element 6 is mounted movably on the intake module 2, so it forms together with the intake module 2 a pre-assemblable unit, so that the intake module 2 with the retaining element 6 arranged thereon can be mounted on the attachment part 3. In order to mount the retaining element 6 displaceably on the intake module 2, a longitudinal guide 15 can be provided on the intake module 2 or on the retaining surfaces 4, which longitudinal guide guides the retaining element 6 on the retaining surfaces 4 or on the intake module 2 in the movement direction 7. In the embodiment shown in FIGS. 1 to 5, this guide 15 is configured as a tongue and groove guide, which is also referred to below with 15. In this tongue and groove guide 15, a groove 16, which is formed parallel to the movement direction 7 is moulded in the retaining element 6, while the associated tongue 17 is moulded on the retaining surfaces 4. The tongue 17 is intermittent or configured in multiple parts corresponding to the retainer gaps 13. In addition to guiding the retaining element 6 parallel to the movement direction 7, the tongue and groove guide 15 at the same time effects form-fitting fixing of the retaining element 6 to the intake module 2 transversely to the movement direction 7 and transversely to the joining direction 8.

In principle, the retaining element 6 can be configured as a profiled rod, which is characterised in that it has a constant cross-sectional profile in its longitudinal direction running parallel to the movement direction 7. The retaining element 6 can be realised particularly inexpensively thereby. If the retaining element 6 is such a profiled rod, the diagrams of FIGS. 2 and 3 should be understood in a simplified manner, since in this case the retaining element 6 must be set back as far as the last counter retainer gap 14 in order to be able to join the intake module 2 to the attachment part 3. However, an embodiment is preferred in which the retaining element 6 has, in the releasing position shown in FIGS. 2 and 3, a plurality of interruptions (not visible here) in a region that interacts with the counter retaining surfaces 5, which interruptions align with the retainer gaps 13 in the releasing position of FIGS. 2 and 3. The respective counter retainer 11 can thus be guided parallel to the joining direction 8 through the associated retainer gap 13 and the associated interruption in the retaining element 6 when the intake module 2 is joined to the attachment part 3.

Figure 5:
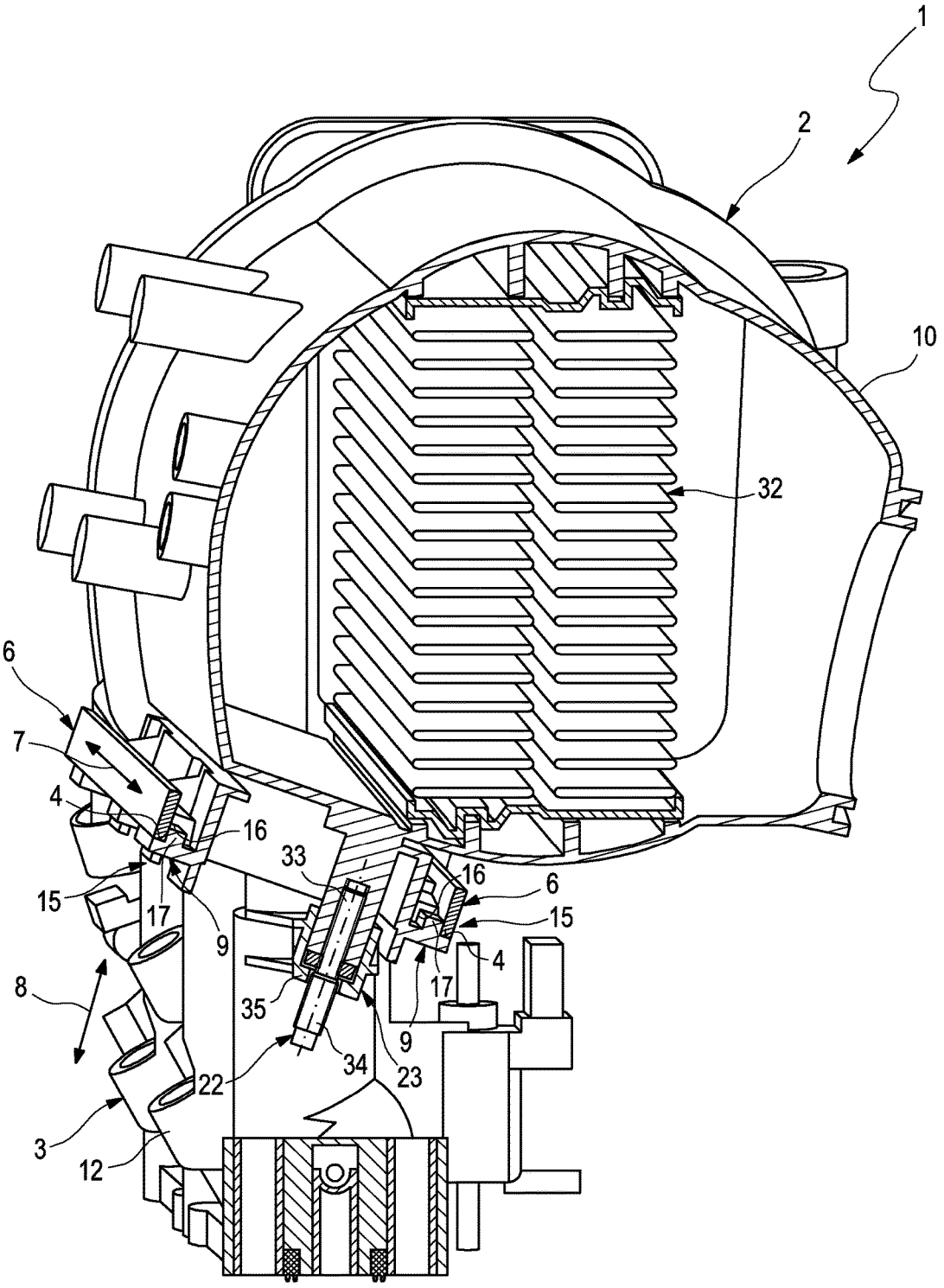
Figure 6:
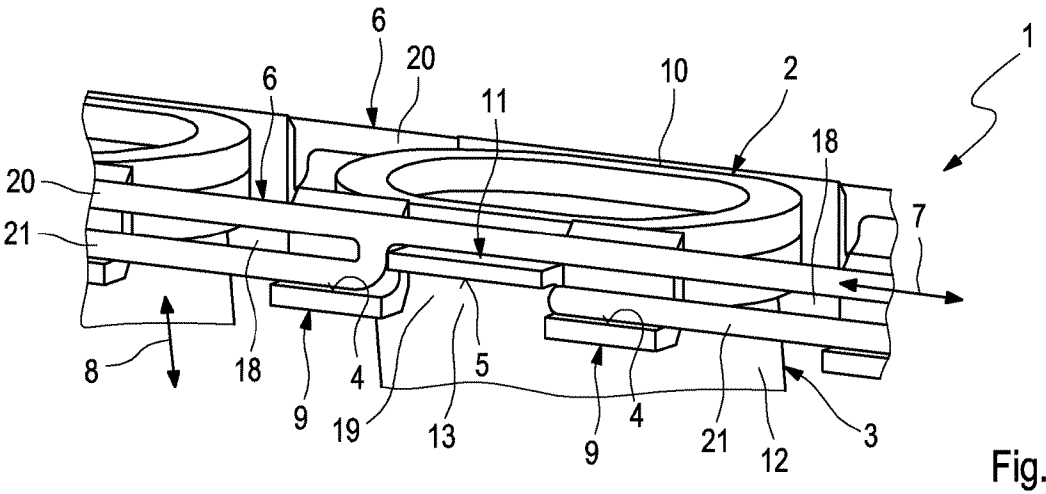

As can be seen in FIG. 5, a charge air cooler 32 can be arranged in the intake module 2 or in the housing 10 of the intake module 2, with the aid of which charge air cooler the charged fresh air, that is, the charge air, can be cooled before passing to the combustion chambers of the internal combustion engine during operation of the internal combustion engine equipped with the combination 1 presented here, which is then designed as a forced induction internal combustion engine. The integration of such a charge air cooler 32 into the intake module 2 gives the intake module 2 a particularly high degree of integration. This can be increased further in that the retaining elements 6 can also be pre-assembled on the intake module 2.

Figure 7:
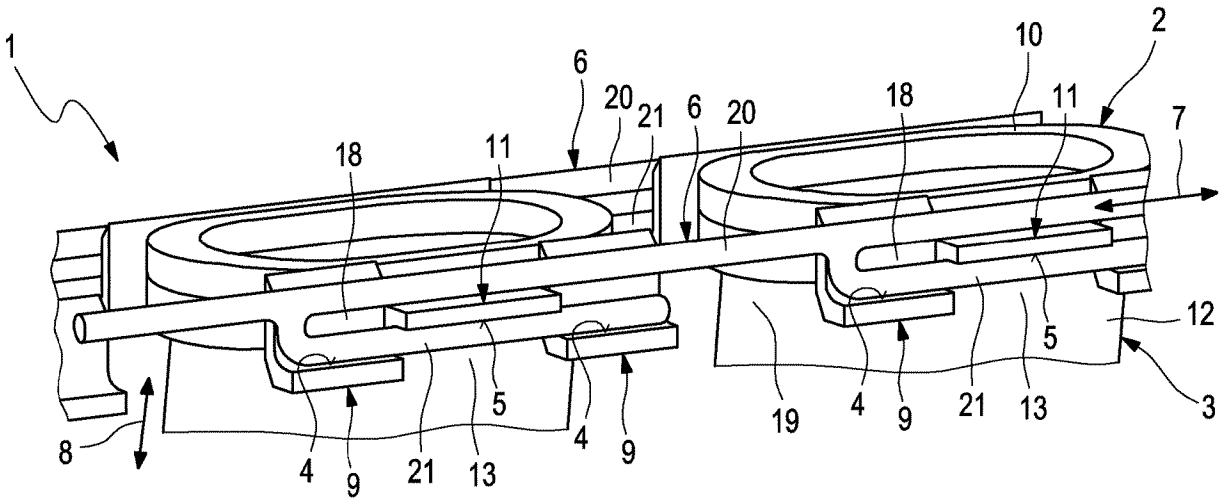

In the embodiment shown in FIGS. 6 and 7, the respective retaining element 6 has a receiving pocket 18 for the respective counter retainer 11, which receiving pocket is open on one side of an insertion gap 19 in the movement direction 7. The respective insertion gap 19 is for its part open on one side parallel to the joining direction 8. If the retaining element 6 is moved into the releasing position according to FIG. 6, the intake module 2, which is only shown in a rudimentary manner in the region of its attachment to the attachment part 3 in FIGS. 6 and 7, can be joined to the attachment part 3 in the joining direction 8, the respective counter retainer 11 then moving parallel to the insertion direction 8 into the respective insertion gap 19. As soon as the predefined relative position between intake module 2 and attachment part 3 is achieved, the respective counter retainer 11 is also arranged flush with the associated receiving pocket 18 in the movement direction 7. The respective retaining element 6 can then be moved in the movement direction 7 from the releasing position shown in FIG. 6 to the securing position shown in FIG. 7. In the process, the retaining element 6 passes over the respective counter retainer 11, as a result of which the latter moves into the respective receiving pocket 18. The respective counter retainer 11 in the associated receiving pocket 18 is then delimited on both sides by the retaining element 6 parallel to the joining direction 8. In the example of FIGS. 6 and 7, the respective retaining element 6 in each case consists of a continuous rod 20, which extends parallel to the movement direction 7, and a plurality of a part-rods 21, which extend parallel to the continuous rod 20 and are connected fixedly to the continuous rod 20 at one end and form the opening for the respective receiving pocket 20 at the other end. The diagrams of FIGS. 6 and 7 relate to the same embodiment but are reversed.

In all the embodiments shown here, the respective retaining element 6 is in each case supported on an adjacent retaining surface 4 on both sides of the respective counter retaining surface 5 in the movement direction 7. This can be seen particularly clearly in FIGS. 6 to 10. In the embodiment shown in FIGS. 1 to 5, the same applies at least to the inner retaining surfaces 4, which are situated between two outer end retaining surfaces 4 parallel to the movement direction 7. Accordingly, the respective retaining element 6 is in each case supported on an adjacent counter retaining surface 5 on both sides of the respective inner retaining surface 4 in the movement direction 7.

As can be seen in FIGS. 1 to 5, a plurality of guide pins 22 can be arranged on the intake module 2, which are aligned parallel to the joining direction 8. A plurality of guide openings 23 are arranged in a complementary manner thereto in the attachment part 3 and are likewise aligned parallel to the joining direction 8. When the intake module 2 is joined to the attachment part 3, the guide pins 22 move into the guide openings 23. A predefined relative position between intake module 2 and attachment part 3 can be produced particularly simply thereby. This predefined relative position then simplifies the displacement of the respective retaining element 6 from the releasing position into the securing position. According to FIG. 5, the guide pins 22 are separate components, which are fastened to the intake module 2 in a suitable manner. In principle, an integral configuration of the guide pins 22 on the intake module 2 is also conceivable. Alternatively, the guide pins 22 can also be formed on the attachment part 3. Accordingly, the associated guide openings 23 are then moulded on the intake module 2. However, the variant shown, in which the guide pins 22 project from the intake module 2, is preferred. An embodiment is particularly expedient in which the respective guide pin 22 can be used to prestress the intake module 2 against the attachment part 3 in order to simplify the movement of the retaining element 6. For example, the respective guide pine 22 according to FIG. 5 can be screwed into the intake module 2 with a first threaded section 33 and project through the respective guide opening 23 with a second threaded section 34 and can be tightened against an enclosure 35 of the guide opening 23 and thus against the attachment part 3 by means of a nut (not shown here) on a side facing away from the intake module 2. The nut can be provided just for the assembly process, to make it easier to displace the retaining element 6. The respective nut can likewise be provided permanently for prestressed fixing of the intake module 2 to the attachment part 3.

Figure 8:
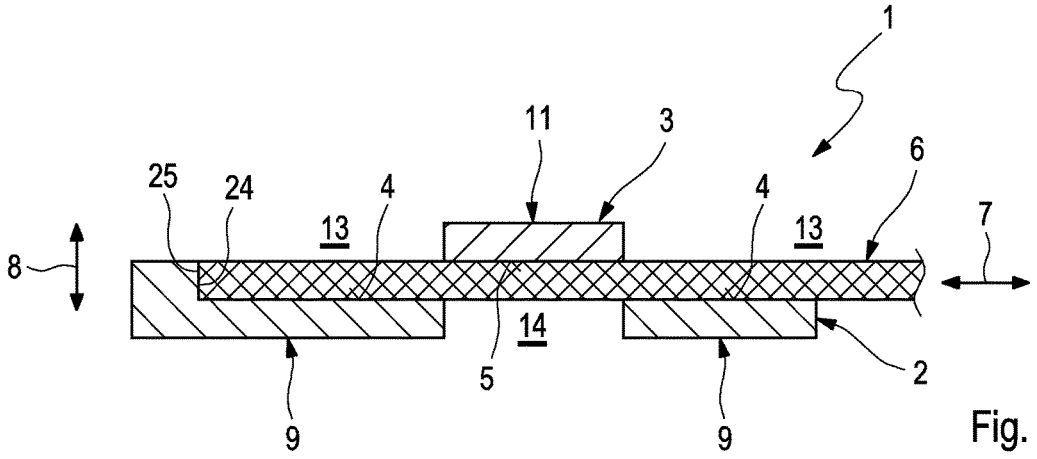
Figure 9:
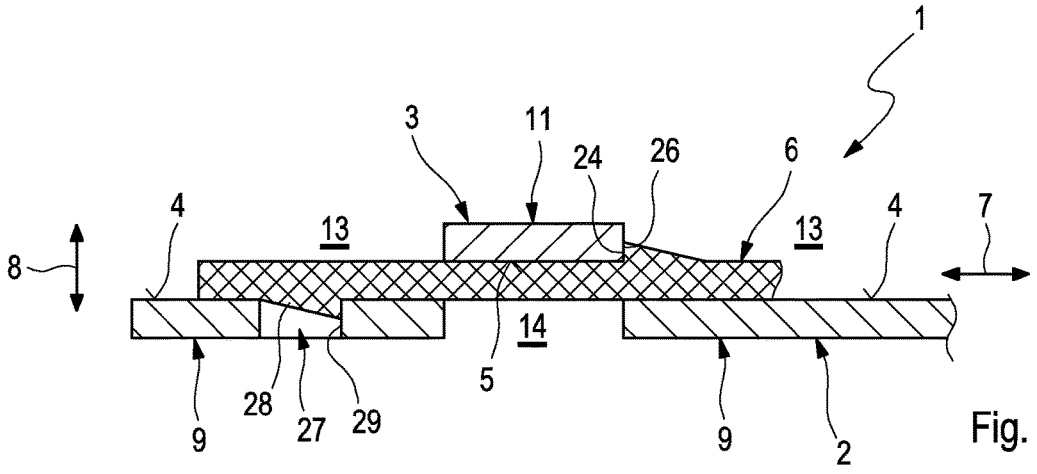

According to FIG. 8, at least one end stop 24 can be provided, which defines the securing position of the retaining element 6. In the example of FIG. 8, the end stop 24 is moulded on one of the retainers 9. The end stop 24 interacts with an end face 25 of the retaining element 6. FIG. 9 shows a further embodiment, in which the end stop 24 that defines the securing position is moulded on the retaining element 6 and to this end interacts with a side wall 26 of one of the counter retainers 11.

According to FIG. 9, at least one latching device 27 can be provided. The latching device 27 is formed and arranged in such a manner that it latches when the securing position is reached and thereby fixes the retaining element 6 in the securing position. In the example, the latching device 27 if formed merely by way of example with the aid of a latching nose 28, which is moulded on the retaining element 6 and interacts with a latching opening 29, which is provided on one of the retainers 9. Such a latching device 27 is expediently combined with such an end stop 24 in such a manner that, when the end stop 24 is reached, the latching device 27 effects the desired latching of the retaining element 6 in the securing position.

Figure 10:
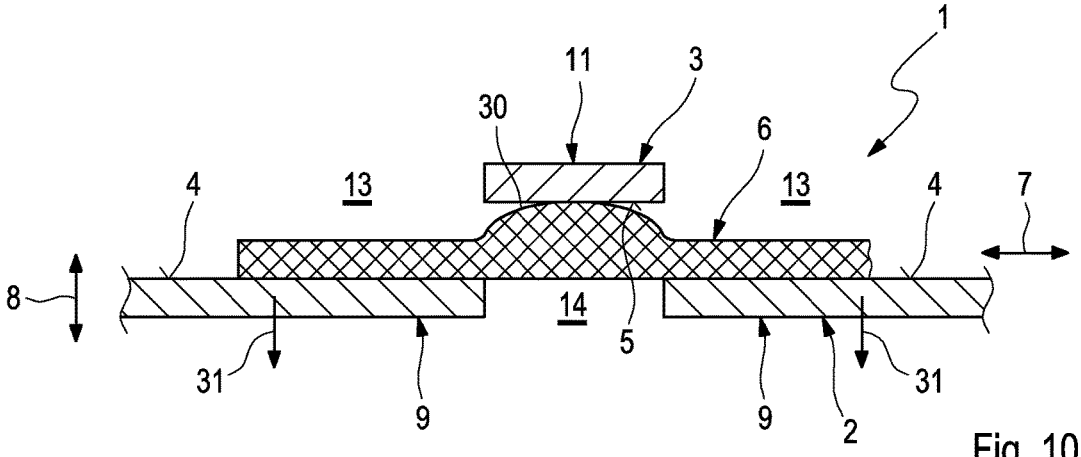

According to FIG. 10, the retaining element 6 can have at least one convex prestressing contour 30. In the securing position shown in FIG. 10, the prestressing contour 30 is opposite one of the counter retaining surfaces 5 in the example shown. The prestressing contour 30 can be used to introduce a prestress 31 into the intake module 2, which prestress is oriented parallel to the joining direction 8 and is indicated by arrows in FIG. 10. The prestressing force 31 presses the intake module 2 against the attachment part 3. Alternatively, a kinematically reversed design is conceivable, in which such a convex prestressing contour 30 is formed on at least one retaining surface 4 and/or on at least one counter retaining surface 5 rather than on the retaining element. With this design too, a prestress 31 or prestressing force 31 can be generated between intake module 2 and attachment part 3 in the securing position.

The invention claimed is:

1. An assembly for an internal combustion engine, comprising: an intake module of a fresh air system for supplying fresh air to at least one combustion chamber of the internal combustion engine and an attachment part attached to the intake module in a joining direction, the intake module including at least one retaining surface facing away from the attachment part, the attachment part including at least one counter retaining surface facing away from the intake module, at least one retaining element disposed between the intake module and the attachment part and moveable in a movement direction extending transversely to the joining direction, the at least one retaining element moveable between a releasing position, in which the intake module is at least one of joinable to and removable from the attachment part, and a securing position, in which the at least one retaining element interacts with the at least one retaining surface and the at least one counter retaining surface to secure the intake module on the attachment part, wherein the at least one retaining surface and the at least one counter retaining surface face each other, and wherein the at least one retaining element in the securing position is arranged between the at least one retaining surface and the at least one counter retaining surface in the joining direction and is supported on the at least one retaining surface and the at least one counter retaining surface in the joining direction, and wherein the at least one counter retaining surface is disposed on a counter retainer of the attachment part, and the at least one retaining element has a receiving pocket for receiving at least one of the retainer and the counter retainer, wherein the receiving pocket is open in the movement direction to an insertion gap and the insertion gap is open parallel to the joining direction.

2. The assembly according to claim 1, wherein a space is formed in the joining direction between the at least one retaining surface and the at least one counter retaining surface, and wherein the at least one retaining element is arranged in the space.

3. The assembly according to claim 1, wherein the at least one retaining element is compressively loaded via the at least one retaining surface and the at least one counter retaining surface.

4. The assembly according to claim 1, wherein the at least one counter retaining surface is disposed on a counter retainer of the attachment part, and wherein the at least one counter retainer is guided along the joining direction through a retainer gap disposed between a plurality of retainers of the intake module arranged along the movement direction, and at least one of the plurality of retainers including the at least one retaining surface.

5. The assembly according to claim 1, wherein the retainer is guided along the joining direction through a counter retainer gap, wherein the counter retainer gap is disposed between a plurality of counter retainers on the attachment part arranged along the movement direction, and at least one of the plurality of counter retainers including the at least one counter retaining surface.

6. The assembly according to claim 1, wherein the at least one retaining element is moveable relative to the intake module and the attachment part, and wherein the at least one retaining element is guided in the movement direction at least one of on the at least one retaining surface and on the at least one counter retaining surface.

7. The assembly according to claim 1, further comprising a tongue and groove guide extending along the movement direction and disposed between (i) the at least one retaining element and (ii) at least one of the at least one retaining surface and the at least one counter retaining surface.

8. The assembly according to claim 1, wherein the at least one retaining element is configured as a profiled rod, the profiled rod including a constant cross-sectional profile in a longitudinal direction extending along the movement direction.

9. The assembly according to claim 1, wherein at least one of the retainer and the counter retainer are insertable into the insertion gap in the joining direction until the retainer is arranged flush with the receiving pocket in the movement direction when the at least one retaining element is moved into the releasing position, and wherein the retainer passes into the receiving pocket and is delimited therein by the at least one retaining element on both sides parallel to the joining direction when the at least one retaining element is moved into the securing position.

10. The assembly according to claim 1, wherein the at least one retaining element is supported on the at least one retaining surface on upper and lower sides of the at least one counter retaining surface in the movement direction.

11. The assembly according to claim 1, further comprising at least one guide pin arranged on the intake module, wherein the at least one guide pin extends along the joining direction and passes into a guide opening disposed in the attachment part when the intake module is attached to the attachment part, the at least one guide pin positioning the intake module in a predefined relative position to the attachment part.

12. The assembly according to claim 1, further comprising at least one guide pin arranged on the attachment part, wherein the at least one guide pin extends along the joining direction and passes into a guide opening disposed in the intake module when the intake module is attached to the attachment part, the at least one guide pin positioning the intake module in a predefined relative position to the attachment part.

13. The assembly according to claim 1, wherein at least one of:

a charge air cooler is arranged in the intake module, and the attachment part is one of an engine block and an intermediate flange for attachment to an engine block.

14. The assembly according to claim 2, where the at least one retaining element is only compressively loaded via the at least one retaining surface and the at least one counter retaining surface.

15. The assembly according to claim 2, wherein the at least one counter retaining surface is disposed on a counter retainer of the attachment part.

16. An assembly for an internal combustion engine, comprising: an intake module of a fresh air system for supplying fresh air to at least one combustion chamber of the internal combustion engine and an attachment part attached to the intake module in a joining direction, the intake module including at least one retaining surface facing away from the attachment part, the attachment part including at least one counter retaining surface facing away from the intake module, at least one retaining element disposed between the intake module and the attachment part and moveable in a movement direction extending transversely to the joining direction, the at least one retaining element moveable between a releasing position, in which the intake module is at least one of joinable to and removable from the attachment part, and a securing position, in which the at least one retaining element interacts with the at least one retaining surface and the at least one counter retaining surface to secure the intake module on the attachment part, a tongue and groove guide extending along the movement direction and disposed between (i) the at least one retaining element and (ii) at least one of the at least one retaining surface and the at least one counter retaining surface, wherein the at least one retaining surface and the at least one counter retaining surface face each other, and wherein the at least one retaining element in the securing position is arranged between the at least one retaining surface and the at least one counter retaining surface in the joining direction and is supported on the at least one retaining surface and the at least one counter retaining surface in the joining direction.

17. An assembly for an internal combustion engine, comprising: an intake module of a fresh air system for supplying fresh air to at least one combustion chamber of the internal combustion engine and an attachment part attached to the intake module in a joining direction, the intake module including at least one retaining surface facing away from the attachment part, the attachment part including at least one counter retaining surface facing away from the intake module, at least one retaining element disposed between the intake module and the attachment part and moveable in a movement direction extending transversely to the joining direction, the at least one retaining element moveable between a releasing position, in which the intake module is at least one of joinable to and removable from the attachment part, and a securing position, in which the at least one retaining element interacts with the at least one retaining surface and the at least one counter retaining surface to secure the intake module on the attachment part, and at least one guide pin arranged on one of the intake module and the attachment part, wherein the at least one guide pin extends along the joining direction and passes into a guide opening disposed in the other of the intake module and the attachment part when the intake module is attached to the attachment part, the at least one guide pin positioning the intake module in a predefined relative position to the attachment part, wherein the at least one retaining surface and the at least one counter retaining surface face each other, and wherein the at least one retaining element in the securing position is arranged between the at least one retaining surface and the at least one counter retaining surface in the joining direction and is supported on the at least one retaining surface and the at least one counter retaining surface in the joining direction.

* * * * *